US005081683A

United States Patent [19]

Torgeson

[11] Patent Number: 5,081,683

[45] Date of Patent: Jan. 14, 1992

[54] LOUDSPEAKERS

[76] Inventor: W. Lee Torgeson, 1124 Lindendale Dr., Pittsburgh, Pa. 15243

[21] Appl. No.: 448,514

[22] Filed: Dec. 11, 1989

[51] Int. Cl.[5] ..... H04R 25/00

[52] U.S. Cl. ..... 381/203; 381/202; 181/144

[58] Field of Search ..... 381/203, 90, 190, 188, 381/191, 152, 196, 202, 182; 181/144, 147, 189

[56] References Cited

U.S. PATENT DOCUMENTS 4,385,210 5/1983 Marquiss ..... 381/203

OTHER PUBLICATIONS

Tremaine, Howard M., *Audio Cyclopedia*, Howard W. Sams & Co., Inc., IN: 1959, p. 16.

*Primary Examiner*—James L. Dwyer
*Assistant Examiner*—Sylvia Chen

[57] ABSTRACT

A loudspeaker characterized by a symmetrical arrangement of planar mid-range and/or low-range drivers about an essentially point source tweeter. A flexible mounting of a speaker diaphragm to a rigid support serves to reinforce the advantages achieved thereby or is utilized independently, for instance to provide an improved sub-woofer.

13 Claims, 7 Drawing Sheets

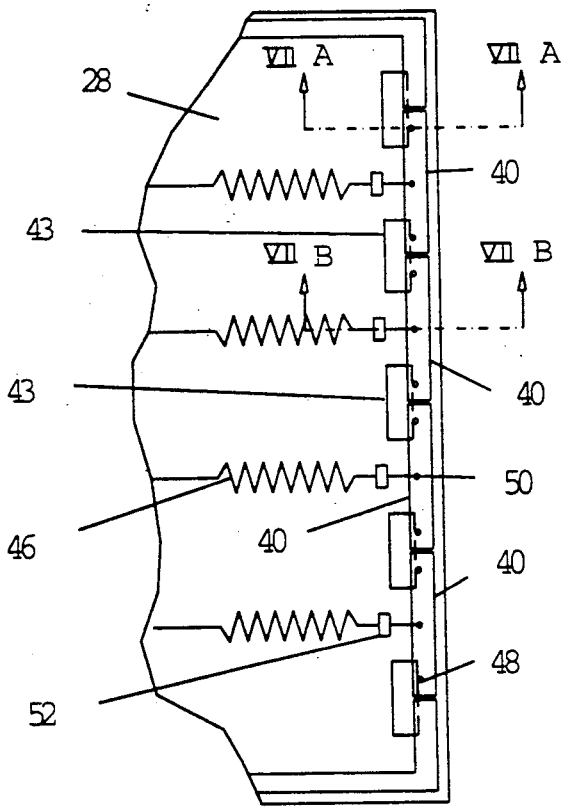
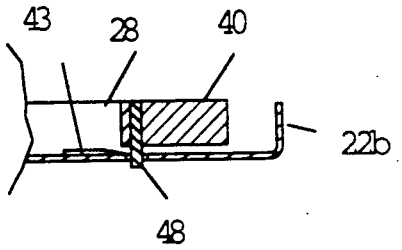
FIGURE 7A
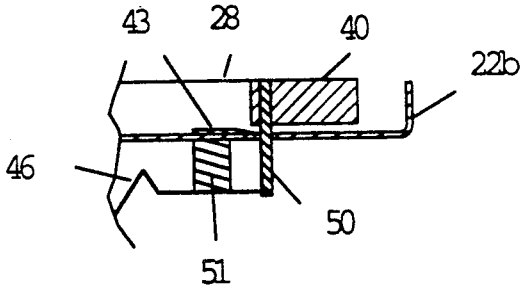
FIGURE 7B
FIGURE 7

LOUDSPEAKERS

TECHNICAL FIELD

This invention relates to loudspeakers for transducing electrical signals into sound.

BACKGROUND ART

Speakers which are categorized as "planar"-type speakers (e.g., electrostatic, ribbon or induction speakers) usually have separate panels 1, 2, and 3 for reproducing, respectively, the low , mid and high-frequency portions of the musical spectrum (FIG. 1). In some cases, the separate panels are stacked vertically, rather than laterally as in FIG. 1. Most of these laterally arranged speakers currently employ separate "line source" radiators. Exceptions to this approach ar the Quad and Beveridge electrostatic speakers. The Quad employs a system of driving an electrostatic panel through a delay network in order to produce a nearly spherical sound wavefront, thus avoiding directional projection of the sound. The Beveridge seeks to accomplish the same objective through use of an acoustic lens.

In FIGS. 1–4 of my U.S. Pat. No. 4,468,530, I disclose a planar, push-pull, induction-type speaker having a high frequency unit placed between low frequency units. The high frequency unit is long, in order to achieve acoustic output matching the low frequency unit. In the embodiment of FIGS. 5 and 6 of that patent, an acoustic lens is employed to prevent vertical beaming of the high frequency sound.

DEFINITIONS

The term "driver" is used throughout the following discussion to describe the individual sound-generating elements of a loudspeaker. In this context, the term "driver" is interchangeable with terms such as "radiator" or "panel", and, for specific elements of the speaker, with terms such as the "woofer" or low-frequency element, the "tweeter" or high-frequency element, etc.

The "crossover frequency" between drivers is defined as the frequency at which the drivers have equal power output.

The "effective" diameter of a driver is the perimeter of the vibrating element divided by Pi. According to this definition, the effective diameter of a circular driver is its diameter.

DISCLOSURE OF INVENTION

Speaker configurations such as shown in FIG. 1 have a serious shortcoming. Because of the lateral and/or vertical displacements of the drivers, acoustic inter-driver interference occurs near the crossover frequencies, adversely affecting the frequency response of the speaker near the crossover frequency. A further problem is that different portions of the frequency spectrum emanate from physically separated elements of the speaker. This adversely affects imaging for stereo sound sources and leads to unnatural sound reproduction. For example, many loudspeakers using multiple drivers sound distinctly different in different parts of the listening room. Another aberration is that the sound changes character with the listener in a seated position compared with a standing position at the same point in the room.

A basic objective of the invention is to achieve the benefits of an "ideal" point-source loudspeaker with a practicable arrangement of coherent planar driver elements. An ideal point-source loudspeaker would radiate acoustic energy uniformly into space at all frequencies. Such a speaker would be entirely free of directional and phase-shift effects at all frequencies. However, it is not practicable to fabricate such a speaker, because a true point source speaker must generate radial vibrations of large amplitude in order to produce low frequencies—while having sufficiently low mass to develop a flat power response at high frequencies as well—requirements which cannot be met with existing technology.

However, it is possible to closely approach the desirable features an an ideal point-source acoustic radiator by using the principles of this invention.

The present invention achieves these goals in a unique way. In its basic outlines, the present invention represents a combination of three ideas all shown, mentioned or alluded to at different locations in my 4,468,530 but never combined in any of the species disclosed in that patent nor ever combined anywhere before, to the best of my knowledge.

One of these ideas concerns the inherent advantage of planar drivers, such as the induction actuated, Mylar film diaphragm drivers disclosed in 4,468,530, over non-planar, for instance cone or dome-shaped, drivers. The advantages of well designed planar drivers include virtual freedom from mechanical breakup of the sound-generating surface(s) and compatibility with dipole operation, with sound emitted from both front and rear surfaces of the planar diaphragm.

A second of the ideas is contained in FIGS. 1–4 in my 4,468,530, the idea being that a symmetrical arrangement of the elements of a loudspeaker results in a speaker in which both elements have the same acoustic center.

The third idea 1 draw upon for the present invention is that mentioned with respect to the description of the embodiment of FIGS. 5 and 6 in 4,468,530, that lateral beaming of the high frequency sound can be avoided by a narrowing of the high frequency driver. However, beaming of sound in a vertical plane Will occur with the geometry shown in 4,468,530, unless an acoustic lens or some other means is used to avoid this phenomenon. Designers of line-source speakers simply make the speaker very long and narrow, depending on the fact that the listener's ears will be somewhere near the vertical center of the speaker, with floor and ceiling reflections helping to reduce directional effects.

In this invention, an effective point source is obtained by dividing the high-frequency element shown in FIGS. 1 and 4 of 4,468,530 into two identical elements and placing them at equal distance above and below a small high-frequency radiator (i.e., a radiating element which is small in all lateral dimensions) placed at the center of the loudspeaker. In this configuration, the new divided elements serve as mid-frequency sound sources, with the added high-frequency element serving to reproduce the highest audio frequencies. If the high frequency driver is circular, the diameter of the sound radiating surface should be about 1.25 inches or less. If the high frequency driver is non-circular, its "effective" diameter should be about 2.5 inches or less, with its greatest dimension lying in the vertical direction. The idea here is that, if a rectangular planar driver is used, it could advantageously be about 0.75 inches wide by 2.0 inches high (in this case with an effective diameter of about 1.75 inches) yielding a broad lateral polar distribution with a more directional vertical distribution—which is not objectionable in view of the greater restriction of listening position in the vertical, as compared with the horizontal, plane.

An important feature of the invention is that all elements of the loudspeaker lie essentially in the same plane. Also, the crossover frequencies and physical sizes of each element are selected so as to avoid directional sound projection from the individual elements within their operational frequency ranges. An essential feature of this concept is that the new midrange driver can be made much shorter since it can have higher mass than the tweeter panel which it replaces (e.g., the driver height can be reduced from about 24 inches to about 9 inches, 4½ inches in each of two elements). With careful design, a loudspeaker of this type behaves as an effective point source over the entire audible frequency range.

Alternatively, a full range point-source speaker could be produced by simply using a high-frequency element having a radiating surface Which is sufficiently small in all lateral dimensions. However, this approach is not practicable at the present sale of (he art because suitable high-frequency drivers do not exist. (The physical reason for this is that the requirements of small size for reproducing the highest frequencies of the audio range conflict with the necessary conditions for reproducing mid-frequencies, which require a much higher volume flow for a flat power response. Thus, if size is restricted in order to achieve adequate high-frequency dispersion, a high vibrational amplitude is required for mid-range response—a condition which is very difficult to achieve without excessive distortion.)

On the other hand, within the scope of the invention, it is possible to combine a small high-frequency driver with flanking planar mid-frequency drivers arranged as in FIG. 1 of 4,468,530, in order to realize many of the advantages of the present invention, while using a conventional cone-type driver for bass output. Still another variant is the combination of mid- and high-frequency drivers of this type with a pair of cone-type loudspeakers, symmetrically placed on each side with respect to the center of the high-frequency driver.

Putting this all together, 1 have discovered that a dramatic improvement in the state of the art is achievable in terms of low harmonic distortion and relative equality of intensity of sound independent of position in the room, by a speaker meeting the following specifications: the speaker has at least two, and preferaby three, drivers arranged essentially coplanarly and serving different frequency ranges, the drivers including a high frequency driver having essentially the same dimensions in all directions in the plane of the speaker and one or more lower frequency, planar-type drivers, the drivers being arranged essentially symmetrically about a common center.

In a further development of the invention, or as an element which can also be applied independently, 1 have discovered that important advantageous (in terms, for instance, of low distortion of the acoustic output of a speaker) can be achieved by a spring-loaded mounting of a speaker diaphragm.

BRIEF DESCRIPTION OF THE DRAWINGS

FIG. 7 is a view according to Arrow Z in FIG. 6, with magnets 18, and panel 22*b* broken away to expose more of the parts of the diaphragm tensioning mechanism of the embodiment of FIG. 6.

FIGS. 7A and 7B are cross sectional views taken according to the cutting planes VIIA—VIIA and VIIB—VIIB, respectively, of FIG. 7.

MODES OF THE INVENTION

Figure 2:
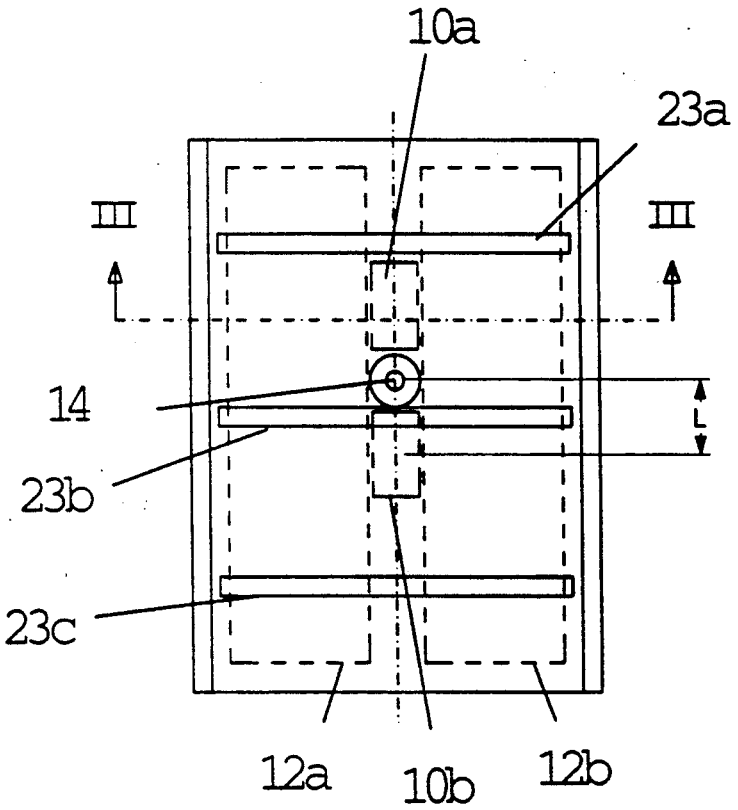
FIG. 2 is an elevational view of a speaker according to the invention.

A basic concept of the invention is the use of a "balanced" planar driver configuration, as shown schematically in FIG. 2, to achieve the essential benefits of a point sound source. FIG. 2 shows a three-way configuration: a small, essentially point source, high-frequency driver (tweeter) placed at the center of the array, centered between identical paired mid- and low-frequency drivers, by which it is possible to achieve in effect a point-source full-range loudspeaker.

Preferably, the mid-frequency drivers are placed above and below the high-frequency driver, with the low-frequency drivers positioned on each side of the mid- and high-frequency units. It is particularly important that the individual drivers shown in the figure lie substantially on the same plane.

Other driver configurations using paired planar drivers can also be used within the scope of the invention. For instance, the low-frequency drivers can be split into two elements each, in order to produce a four-way speaker (e.g., see FIG. 2B).

Figure 4:
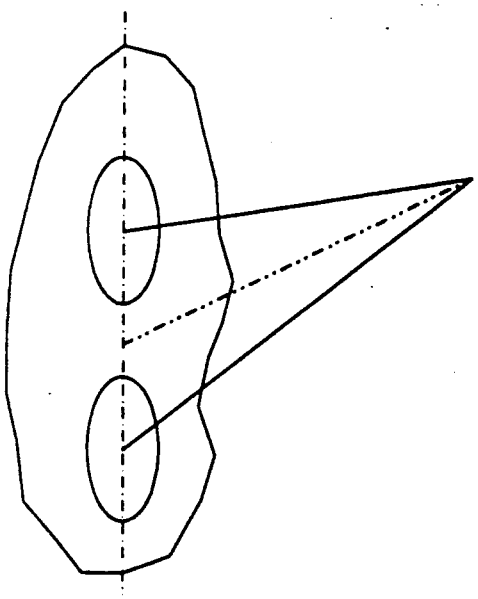
FIG. 4 is a schematic drawing for illustrating the cooperation of the separated drivers used in the invention.

With respect to the symmetrical arrangement of the mid- and low range driver halves, it can be demonstrated that two identical planar speakers mounted on a large baffle are acoustically equivalent to a single larger speaker centered at the midpoint between them. This is illustrated in FIG. 4, which shows two planar coherent radiators mounted in a plane wall. In this "ideal" case, the sound appears to come from a point midway between the radiators. Similar results are obtained when closely matched drivers are mounted on a finite baffle.

Speakers employing cone and dome units arranged symmetrically have been introduced; e.g., speakers offered by Cerwin Vega, by TDL Electronics and by Polk. However, a distinction must be drawn between speakers employing cone drivers, which produce incoherent output due to cone breakup, and planar speakers which, when properly designed according to the principles set forth herein and in my U.S. Pat. No. 4,468,530, are capable of a close approach to coherent output. Another fundamental difference is that the "effective" axial location of the sound source is not fixed with cone-type speakers, due to their shape; in fact, the apparent axial sound source generally varies with frequency, moving toward the voice coil at higher frequencies.

With the arrangement shown in FIG. 2, the full sound spectrum appears to come from a point at the geometric center of the array; i.e. from a single point in space as would be the case with the "ideal" point source loudspeaker.

With respect to the details illustrated, the speaker of FIG. 2 employs planar drivers for the mid- and low-frequencies, these drivers being comprised of elements 10*a* and b, and 12*a* and *b*, respectively. These may be push-pull planar induction drivers of design as disclosed in my 4,468,530. The mid and low-frequency driver elements are closely matched pairs which ar symmetrically positioned with respect to the high frequency driver 14 at the axis of the speaker. The members of the pairs are as close together as possible.

A small diameter, soft dome, high-frequency driver is shown for driver 14, although other compact high-frequency units known in the art may also be used. Small planar high frequency drivers ray also eventually become available for use in the present invention.

Further subdivision of the low frequency drivers is possible, for instance for creating inner, mid-bass drivers and outer, low bass drivers.

Figure 2A:
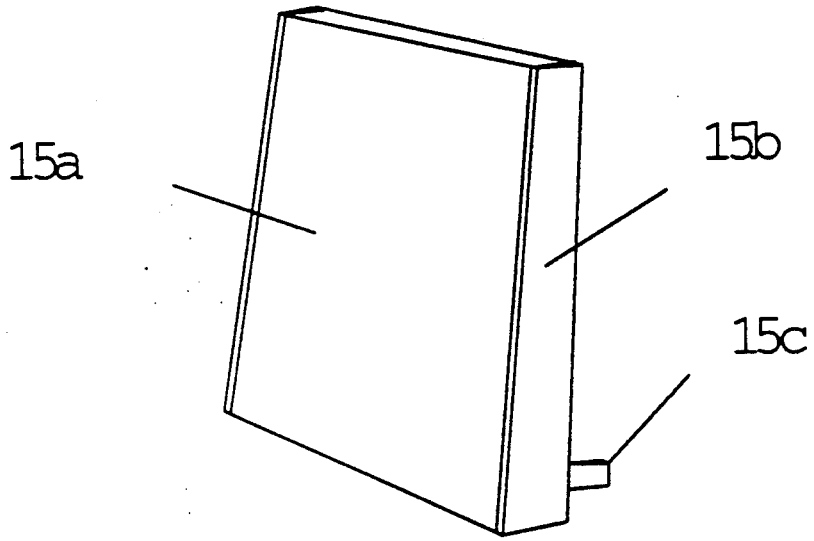
FIG. 2A is an isometric view of an ornamental encasement of a speaker as in FIG. 2.

FIG. 2A shows an ornamental encasement of a speaker as in FIG. 2. The structure of FIG. 2 is hidden in FIG. 2A by a fabric 15*a*. The frame is broader at the bottom, both in width and in depth, for esthetic purposes, and is provided with feet 15*c* to keep it upright.

Figure 2B:
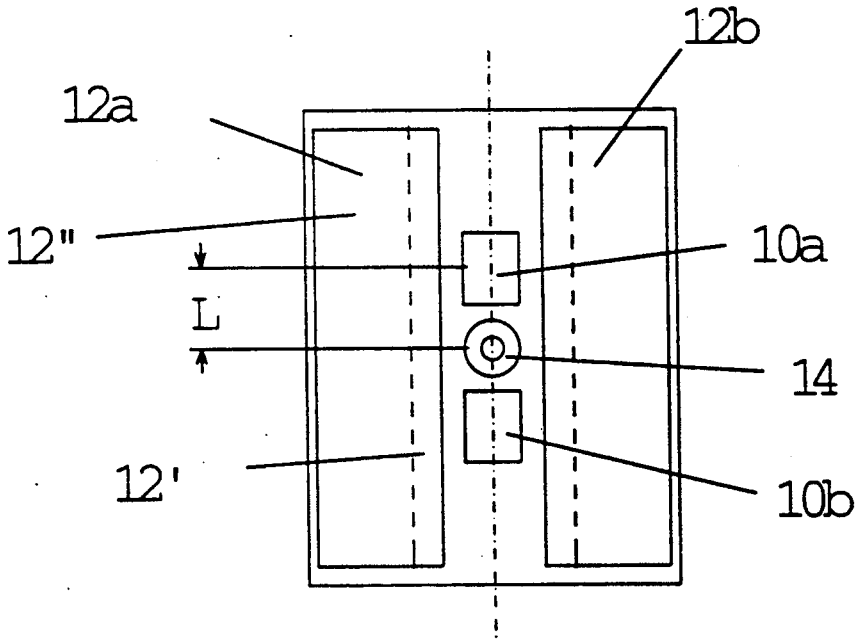
FIG. 2B is a view as in FIG. 2 of an alternate embodiment of the invention.

FIG. 2B illustrates, by dashed lines on either side of the vertical axis, the splitting of the low-frequency drivers 12*a* and 12*b* each into two elements, for creating individual mid-bass drivers 12' and low-bass drivers 12''.

Figure 3:
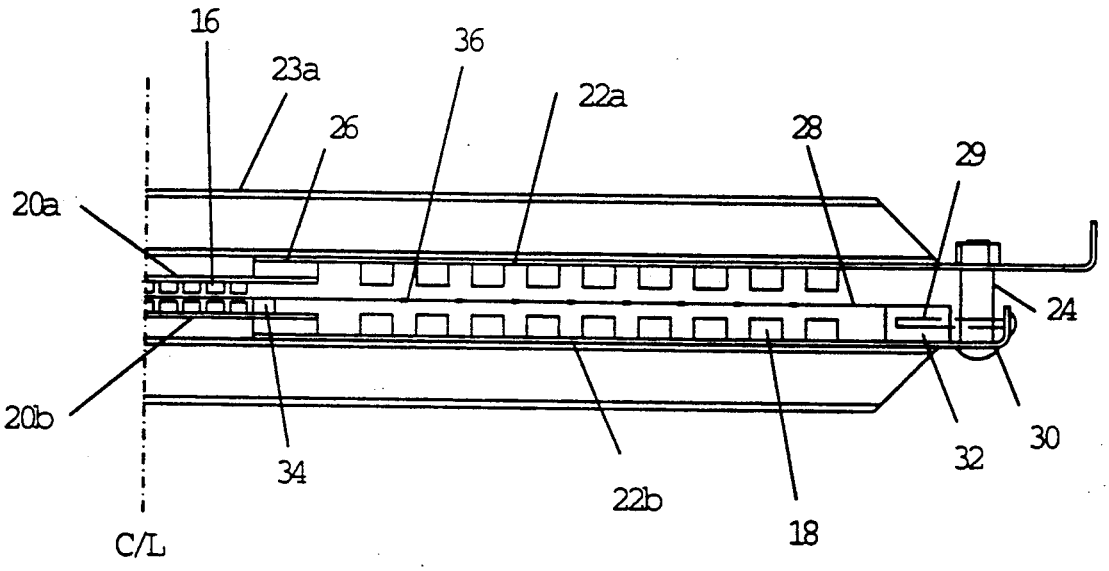
FIG. 3 is the right half of a cross section viewed according to the cutting plate III—III of FIG. 2.

FIG. 3, which is a view on the basis of cutting plane III—III of FIG. 2, shows only the right half of the speaker, since the left half across the axis of symmetry is identical.

It is to be noted in FIG. 3 that magnets are mounted on both sides of the conductor-carrying diaphragm. This "push-pull"-type induction driver is preferred for the present invention, because of its greater linearity as compared to single-ended induction drivers, which employ magnets on only one side cf the diaphragm.

Comparison of FIG. 3 with FIGS. 1–4 of my 4,468,530 will show that the mid- and low-frequency drivers of this embodiment are built using many of the principles more fully explained in 4,468,530.

The mid- and low-frequency magnets 16 and 18, respectively, of this embodiment are bonded to perforated steel panels 20*a* and 20*b* of the mid-frequency driver and 22*a* and 22*b* of the low-frequency driver.

Figure 9A:
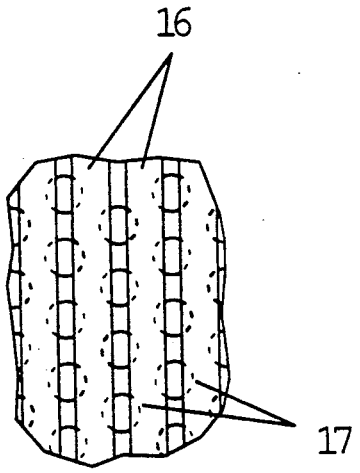
FIGS. 9A and 9B are plan views showing the positioning of the magnets on perforated steel panels.
Figure 9B:
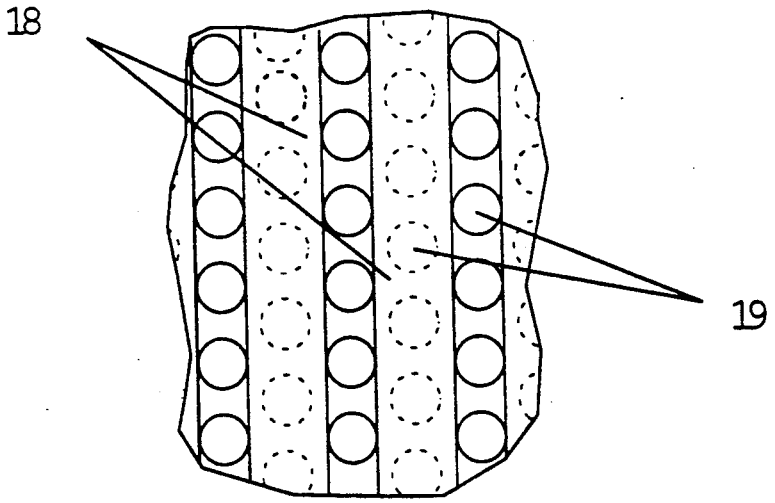

FIGS. 9A and 9B show how the magnets are mounted on the perforated steel panels when standard staggered perforated steel sheet material containing staggered holes 17 and 19 is used for fabricating the speaker. In general, apart from cost considerations, it may be advantageous to use specially punched sheets which offer greater design flexibility.

Panels 22*a* and 22*b* are stiffened by steel channels 23*a*, 23*b*, and 23*c* (see also FIG. 2). Stands, of which one, 24, is shown, space the panels 22*a* and 22*b*. Spacers 26 are bonded between panels 20*a* and 22*a* on the one hand and panels 20*b* and 22*b* on the other, in order to achieve central positioning of the panels 20*a* and 20*b*.

A speaker diaphragm, or membrane, in the form of Mylar film 28 is tensioned by woodscrews 29 extending between the lip 30 of panel 22*b* and frame 32, on whose upper surface film 28 is bonded. Prior to installation the Mylar film is pre-tensioned in a stretching frame (not shown). Contact adhesive is applied to the frame elements 32 and 34 and to the portions of the film which come into contact with the frame elements and the film is then bonded in place. Thus, the film for the mid-frequency drivers is isolated from vibrations of the low-frequency drivers. Film 28 carries conductors 36, as more fully explained in my 4,468,530.

It is compatible with the invention to interchange the positions of the mid- and low-frequency drivers in FIG. 3, although the arrangement shown, with the centers of the mid-frequency drivers along a vertical line is preferred.

Figure 5:
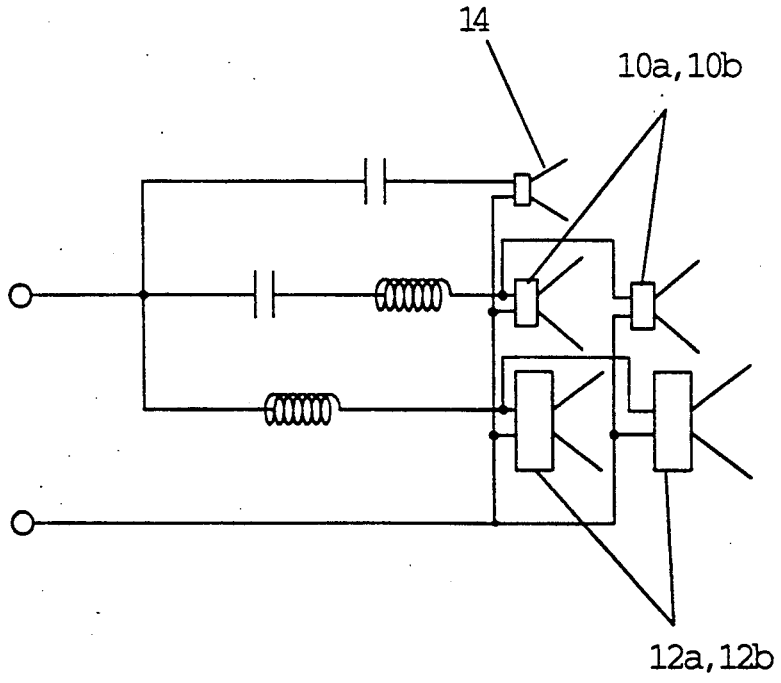
FIG. 5 is a schematic drawing illustrating the electrical interconnection of the drivers used in the invention.

FIG. 5 shows the paired drivers connected in parallel to a three-way, 6 db/octave crossover network. In many cases, it may be preferable to connect the drivers in series. Although more complex crossover networks can be used, the quarter-section crossover network shown in the figure is preferred because of its superior phase shift properties.

The network shown in FIG. 5 is suitable for low impedance induction, dynamic or ribbon drivers. An electrostatic array might employ a different network, but the network should generally provide 6 db/octave attenuation characteristics.

The arrangement shown in FIG. 2, with the mid-frequency drivers located with their centers on a vertical line, yields a broad lateral and a somewhat less broad vertical sound distribution pattern when a small high-frequency driver (e.g., a 1 -inch soft dome tweeter) is used. The upper crossover frequency should be as low as possible consistent with low tweeter distortion.

For best results in terms of proper distribution of sound up and down in a room, the mid-frequency drivers should be located as close as possible to the center of the array, i.e. as close as possible to the tweeter. Thus, the ratio of the distance L (see FIG. 2) to the wavelength at the upper crossover frequency should lie in the range 0.5–2, and preferably 1.0–1.5. (Since L is measured to the center of the individual mid-frequency driver elements, this requirement limits the overall height of these driver elements. The distance between the centers, or 2L, will be in the ranges 1–4 and 2–3 times the wavelength at the crossover frequency.) An alternative and essentially comparable way of specifying the requirement of this paragraph is that the maximum distance from the center of the high frequency driver to the outer edge of the mid-frequency planar drivers should lie approximately in the range 1–3 times the wavelength at the crossover frequency, with the lower limit being more a limit of practicalities, it being recognized that values below 1 would be more desireable if adequate undistorted sound output could be achieved. In order to get a broad lateral distribution of sound, the maximum width of the mid-frequency driver should be approximately in the range 0.7–1.5 times the wavelength at the crossover frequency between the high frequency driver and the mid-frequency driver.

The same general guideline applies to the low-frequency drivers—they should be located as close as possible to the centerline of the array. Also, the overall height of the low-frequency drivers should not be greater than about twice the wavelength at the crossover frequency between the low- and mid-frequency drivers. Generally, a speaker of this type will employ three drivers as shown. If additional drivers are used, the same guidelines would apply—that is, the drivers should be symmetrically placed with respect to the center of the array and their sizes should be correspondingly related to the shortest Wavelengths in their operating frequency ranges.

These size restrictions ensure that the sound radiation from each driver pair within their respective operating frequency ranges will be essentially free from lobing or objectionable directional effects. In actuality, the polar radiation pattern developed by a planar array meeting these requirements will be preferable to that of the hypothetical point-source radiator in that the polar distribution of sound intensity is somewhat restricted in the vertical plane, resulting in less reflected energy from the floor of the listening room.

With respect to driver requirements, planar drivers designed for use in the present invention must meet several requirements. First, they should be capable of closely approaching coherent output within their operating frequency ranges.

Figure 1:
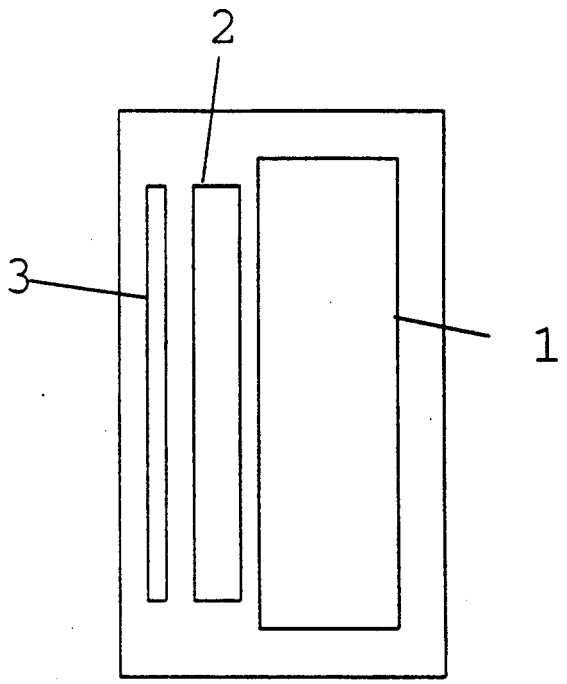
FIG. 1 is an elevational view of a prior art speaker.

Another very important requirement is that each driver be capable of operating effectively in close proximity to the other drivers in the array. In some important cases this may not be possible. For example, certain ribbon drivers have a very low resonance frequency due the fact that the ribbon has very low tension. If such a driver is placed between two large low-frequency drivers, as shown in FIG. 3, the high acoustic pressure generated by the low-frequency drivers at low frequencies will cause substantial vibration of the ribbon. This in turn may result in significant IM distortion since the ribbon will experience vibrational amplitudes much larger than would occur when it is used alone. The most feasible use of conventional ribbon technology is With line-source drivers, which tends to aggravate the problem of coupling unless the side-by-side configuration shown in FIG. 1 is used. This is also the case with certain induction drivers which have low resonance frequencies and also with single-ended ribbon or induction speakers which will generate distortion when subjected to large-amplitude vibrations induced by acoustic pressure coupling. Induction, electrostatic and ribbon drivers can be developed for use in the present invention if they are designed to have relatively low compliance below about 200–300 Hz.

In an example of the speaker of the invention as illustrated in FIGS. 2 and 3, push-pull induction drivers are used for mid-range and bass frequencies. A small-diameter soft dome high-frequency driver is applied as the tweeter, although other compact high-frequency units known in the art (e.g., piezoelectric, induction units using high-energy magnets, etc may also be used.

The individual induction drivers are of the same type as those defined in my earlier U.S. Pat. No. 4,468,530, dated Aug. 28, 1984. These drivers are particularly advantageous for high quality applications because of their low distortion.

Representative dimensions for an example of the invention are:

Height (see FIG. 2)—29 inches
Width—21 inches
Low-frequency drivers (2): 26 inches high by 8.0 inches wide
Mid-frequency drivers (2): 4.5 inches high by 2.375 inches wide
Magnets (low-frequency unit): Plastiform (a product of 3-M Company); 0.25 inches thick by 0.375 inches wide; 0.65 inches lateral spacing; magnetic gap: 0.250 to 0.350 inches
Magnets (mid-frequency unit); Plastiform; 0.125 inches thick by 0.188 inches wide; 0.27-inch lateral spacing; magnetic gap: 0.10 to 150 inches
Conductors (low-frequency unit): 4 passes, #24 aluminum wire connected in series; nominal 6-ohm resistance
Conductors (mid-frequency unit): 3 passes, #32 aluminum wire connected in series; nominal 6-ohm resistance
High-frequency driver: ¾-inch dome unit
Crossover frequencies: 800, 4500 Hz
Diaphragm material: 0.25-mil Mylar.

The "magnetic gap" dimension is the distance between the push-pull magnets shown in the section view of FIG. 3. It defines the maximum peak-to-peak vibrational amplitude of the induction driver. Of course, other dimensions and design parameters are compatible with the invention as long as the general guidelines of driver spacing from the tweeter axis are met (spacings are referred to the center of each induction unit) and the drivers are symmetrically located. Symmetrical spacing is most important for the mid-range drivers.

The tweeter/mid-range drivers can be raised slightly (e.g.. as in FIG. 2) above the center of the low-frequency drivers if desired. (This—in conjunction with the rearward tilt of the enclosure shown in FIG. 2A—raises the mid-/high-frequency sound source to ear level for a seated listener. For best results the displacement should not be greater than about 20 percent of the wavelength at the bass crossover frequency.) Mechanical damping of the diaphragm may be provided by introducing acoustic resistance across the perforated panel (e.g., by adjusting the hole size and number of holes per unit area and/or by gluing open-cell foam or fabric to the perforated panels to obtain the desired frictional air resistance). The induction driver design can be scaled up or down to a degree from the dimensions given if desired (the guidelines of the earlier U.S. Pat. No. 4,468,530 should be followed for maximum linearity of the push-pull induction drivers). If the low-frequency driver is made larger in order to increase its acoustic output, it may be desirable to add the optional mid-bass driver shown in FIG. 2B.

An important advantage of the invention is the fact that, as illustrated in FIGS. 2 and 3, the entire driver assembly can be fabricated on a single rigid frame. Not only is this arrangement cost-effective but it also ensures that the individual drivers are as closely spaced as practicable, thus benefiting the overall speaker performance.

The section view in FIG. 2 shows a rigidly-mounted frame for support of the diaphragm (refer also to the earlier patent for details of the induction speaker design). Although very good results can be obtained with a rigid mounting of this type, it has been found that a flexible frame mounting of the diaphragm (FIG. 6) provides greatly improved linearity at the lowest bass frequencies, which require a large amplitude of vibration for high acoustic output. Flexing of the frame can be accomodated by using a segmented frame as shown in FIG. 7.

Figure 6:
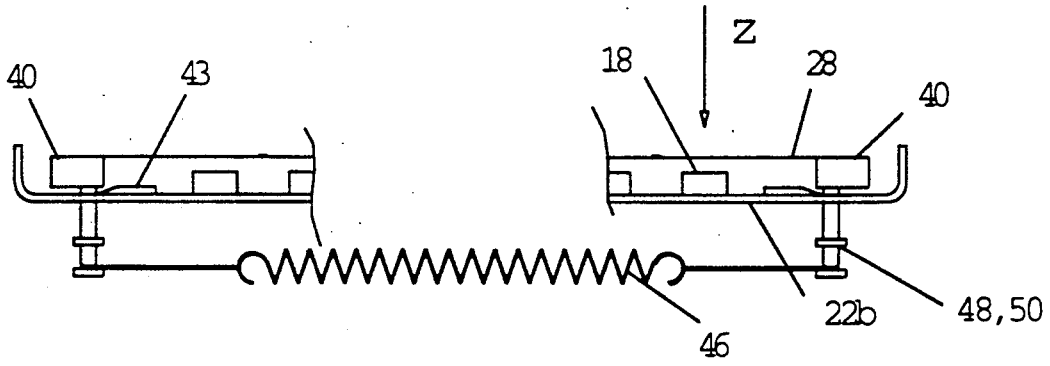
FIG. 6 is a cross section viewed according to the cutting plane III—III of FIG. 2 showing another embodiment of tensioning as compared to that shown in FIG. 3. Panels 20*a*, 20*b* and 22*a* of FIG. 3 have not been shown in FIG. 6, since they are not involved with the structural modifications characterizing the embodiment of FIG. 6.

In general reference to FIG. 6, a typical frame segment, or element, is supported at each end by means of rods bearing against knife edges mounted on the perforated steel panels, allowing the frame segment to pivot about the knife edges during vibration of the diaphragm. The spring shown in the figure applies a tensioning force to the long rod installed in the frame segment near its center. As shown, the spring extends across the width of the low frequency driver, serving to keep the membrane tensioning force very nearly constant during operation. This desirable condition is obtained by using long springs which stretch several inches in providing the static membrane tension. Since the maximum deflection of the frame segments is of the order of 0.01 inches at full output, the tension force remains nearly constant at all times, virtually eliminating nonlinear stretching of the membrane at high output levels. This tensioning system has been found experimentally to greatly reduce distortion; e.g., for the parameters of the preferred configuration given above, the segmented design reduces the harmonic distortion at 50 Hz for a SPL of 100 db (at one meter) from 12–15 percent for a rigid frame to about 1.5 percent or less with a segmented frame. (In a test speaker, 5 lateral frame elements were used on each side with rigidly mounted frame elements at the top and bottom.) Experimentally, I have found that the film tension should be about 0.5 pounds/inch for 0.25-mil Mylar film in order to minimize harmonic distortion and to avoid "creep" of the stretched film. Within the scope of the invention, the number of frame segments can range from one to several per side. The top and bottom frames can also be segmented if desired, as can the frames supporting the film for the mid-range drivers. However, the greatest incremental benefits are obtained by tensioning the lateral frame elements, i.e , those along the long sides, of the bass drivers as described.

The static membrane tension must be carefully selected in order to obtain the desired resonance frequency of the low-frequency drivers (the resonance frequency should be the same for both drivers). With the tensioning system shown in FIG. 6, uniform tensioning can be obtained by closely matching the springs. The film thickness can also be adjusted if necessary to achieve the desired resonance frequency.

In some cases, it may be desirable to vary the spring tension from top to bottom of the bass drivers in order to broaden the bass resonance peak. This can most advantageously be done with the tensioning system shown in FIG. 6, i.e., with the spring running across the speaker so as to equally tension each segment for both bass driver elements.

Instead of rods, screws can be used, in order to permit adjustments of the frame segments after assembly. However, for a production speaker, it is advantageous to use grooved rods, instead of screws, for engaging the knife edges; the rods may be fabricated to the exact length and groove location required, providing a precise means for positioning the frame segments during assembly. Similarly, a grooved center rod may be used with the end of the spring fitted into the groove during assembly.

This tensioning system can be applied to any planar loudspeaker using thin plastic film or foil which is caused to vibrate in order to produce sound output. The benefits will be greatest fo, those designs which employ linear drive systems for causing vibration of the film.

A very effective, low-distortion sub-woofer (sub-bass) induclion driver may be fabricated by combining a number of bass driver elements of the type shown in FIG. 6 (and in the prior U.S. Pat. No. 4,468,530) using segmented frames to permit large vibrational amplitudes. A sub woofer of this type, which is typically limited to frequencies below 60–200 Hz, can be used either separately or with the point-source loudspeaker. Also, high acoustic output at low distortion can be achieved with a large speaker of this type for use with an electronic organ for use in theaters or auditoriums.

With respect to the specifics of the embodiment of FIG. 6, individual frame elements 40 are mounted for spring-biased rotation about center points on knife edges 43. Further details of this alternate mode of tensioning film 28 are set forth in FIGS. 7 to 8.

Figure 8:
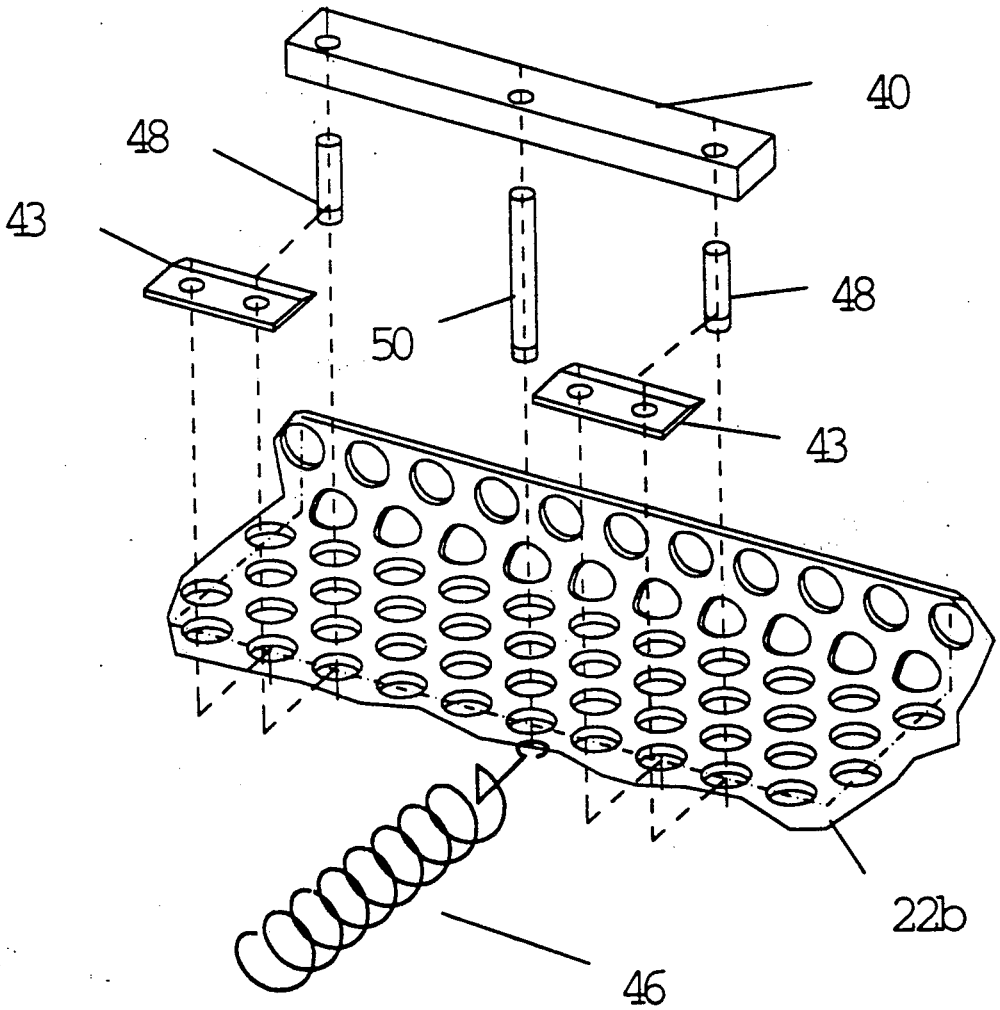
FIG. 8 is an exploded view of the parts forming the diaphragm tensioning mechanism of the embodiment of FIG. 6.

With reference first to FIGS. 7 and 8, it will be seen that each frame element 40 is associated with two laterally situated pivot rods 48, two laterally situated knife edges 43, one central tensioning rod 50 and one spring 46.

As shown in FIG. 7A, each pivot rod 48 seats tightly in a frame element 40. Knife edge 43 is secured to a rigid support in the form of panel **22*b* and rests in a groove 52 on the exposed end of rod 48. A pivot axis for each frame element 40** is defined by the two points of contact at knife edge and groove in each of the two pivot rods associated with each frame element.

FIG. 7B shows tensioning rod 50 also tightly seated in a frame element 40. A tensioning force is applied to the exposed end of the tensioning rod by an associated spring 46. While it might appear in FIG. 7B that rod 50 is in contact with a knife edge 43, such is not the case in this embodiment, as will be apparent from reference to FIG. 7. Damper 52 may be a pad of stable elastomer or foam rubber seated between panel **22*b* and spring 46**. Alternatively, a damper based on a Newtonian grease confined in a dashpot may be used. The damper introduces a resistance proportional to velocity to control the speaker output at resonance.

I have found that performance of the speaker is generally improved by avoiding undue restriction of air movement associated with vibration of the diaphragm. While damping must be applied to control the amplitude of vibration at resonance (e.g., the use of fabric or foam means for flow restriction as previously described for the rigid-frame loudspeaker shown in FIG. 2 , the use of damping pads or other damping means applied directly to the springs or rod coupling elements as shown in FIG. 7 is distinctly preferable for the flexible frame film mounting system.

During assembly of the speaker, the springs are stretched by 2–4 inches or more, well within their linear range of extension. For example, with 0.25-mil Mylar film, a tension of around 2.5 pounds is used. The corresponding spring constants of the tensioning springs would lie in the range: 0.5 to 1.5 pounds/inch. These values correspond to a lever arm between the spring attachment point and the knife edge equal to the distance from the knife edge to the plane of the film. Thus, the overall force applied to tension the film is equal to the spring force. Other lever arm ratios are generally compatible with the invention. For a given spring and film, the amount of stretch would correspond to the desired membrane tension, with a spring elongation of 2–4 inches being desirable at the operating tension.

The frame elements are held in position during assembly by suitable stops (not shown) inserted, for instance, into the gaps between frame elements 40 and panel 22*b*. After attaching the film, the stops are removed so that the spring force is transferred to the film.

Hinges or other pivoting means can also be used in place of knife edges. It is generally desirable that the pivots should accurately locate the frame elements and that they should have sufficiently low friction to allow free movement of the frame elements without a significant increase in membrane tension.

Besides the lever-type application of spring tension shown in FIGS. 6–8, it is within the broader concept of the invention to use a direct application of spring force to the diaphragm edges, such as is done in the case of trampolines.

A very flexible thin plastic film may be added to seal the frame elements to the perforated panel at its edges to avoid shunting effects induced by the acoustic pressure developed by the vibrating diaphragm this is significant only at low frequencies).

The above discussion applies specifically to the use of a flexible frame mounting for the bass driver elements. The same approach can be applied to the midrange driver if desired. This may not be necessary, however, because of the relatively low amplitude required for adequate midrange acoustic output.

The performance of the speaker assembly shown in FIG. 2 can be enhanced by mounting it on a suitable baffle. The baffle, typically fabricated from ¾-inch plywood or particle board, may be tapered in width from top to bottom for decorative purposes. It should extend about 4–6 inches or more around the edges of the driver assembly. Also for decorative purposes, tapered side trim panels 2-14 3 inches wide may added advantageously, since they increase the air-path distance from the front to the rear edges of the bass drivers, thereby increasing the acoustic loading on the vibrating diaphragm. The baffle also serves to hold the driver assembly in the most effective position and height for optimum sound distribution. The edges of the driver may be sealed to the baffle to prevent shunting of air resulting from the acoustic pressure developed by the vibrating diaphragm.

The above discussion applies to any diaphragm-type speaker, whether it be an induction, electrostatic or ribbon speaker. Low-frequency distortion will generally be reduced by using a flexible, essentially constant-tension mounting for the diaphragm. The benefits will be greatest for low-frequency drivers employing low-distortion electrostatic or electromagnetic drive systems drivers: e.g., push-pull configurations.

I claim:

1. A loudspeaker comprising at least two drivers arranged essentially coplanarly and serving different frequency ranges, the drivers including a high frequency driver having essentially the same dimension in all directions in the plane of the speaker and a lower frequency range, planar driver, the planar driver being arranged with at least essentially bilateral symmetry about the center of the high frequency driver.

2. A loudspeaker as claimed in claim 1, further comprising a second planar driver for a frequency range beneath that of the first planar driver, the second planar driver being arranged essentially coplanarly with the aforementioned drivers and with at least essentially bilateral symmetry about the center of the high frequency driver.

3. A loudspeaker as claimed in claim 2, the first planar driver lying spatially above and below the high frequency driver, the second planar driver lying spatially to the right and left of the high frequency driver and the first planar driver.

4. A loudspeaker as claimed in claim 3, the maximum width of the first planar driver being in the range 0.7–1.5 times the wavelength at the crossover frequency between the high frequency driver and the first planar driver.

5. A loudspeaker as claimed in claim 4, the first planar driver being comprised of elements (10*a* and 10*b*), the ratio of the distance between the centers of elements to the wavelength at the crossover frequency between the high frequency driver and the first planar driver being in the range 1–3.

6. A loudspeaker as claimed in claim 1, the drivers being mounted on a baffle means allowing radiation of sound from both the front and rear of the speaker, the baffle acting to screen the radiation from the front from the radiation from the rear.

7. A loudspeaker as claimed in claim 2, the drivers being mounted on a baffle means allowing radiation of sound from both the front and rear of the speaker, the baffle and the second planar driver acting to screen the radiation from the front from the radiation from the rear.

8. A loudspeaker as claimed in claim 2, the planar drivers being push-pull drivers.

9. A loudspeaker as claimed in claim 1, the maximum distance from the center of the high frequency driver to the outer edge of the planar driver being in the range 1–3 times the wavelength at the crossover frequency between the drivers.

10. A loudspeaker as claimed in claim 1, the effective diameter of the planar driver being approximately equal to or less than the wavelength at the crossover frequency between the drivers.

11. A loudspeaker as claimed in claim 2, the high frequency driver and the first planar driver being raised above the center of the second planar driver, the displacement being not greater than about 20% of the wavelength at the crossover between the first and second planar speakers.

12. A loudspeaker as claimed in claim 1, the planar driver comprising a diaphragm, a rigid support, and a means for providing a flexible attachment of the diaphragm to the rigid support.

13. A loudspeaker as claimed in claim 2, the second planar driver comprising a diaphragm, a rigid support, and a means for providing a flexible attachment of the diaphragm to the rigid support.

* * * * *